US008690542B2

(12) United States Patent
Holmberg

(10) Patent No.: US 8,690,542 B2
(45) Date of Patent: Apr. 8, 2014

(54) METHOD AND ARRANGEMENT FOR SOFT START UP OF A PUMP SYSTEM

(75) Inventor: Mikael Holmberg, Porvoo (FI)

(73) Assignee: ABB Oy, Helsinki (FI)

( * ) Notice: Subject to any disclaimer, the term of this patent is extended or adjusted under 35 U.S.C. 154(b) by 1032 days.

(21) Appl. No.: 11/783,959

(22) Filed: Apr. 13, 2007

(65) Prior Publication Data

US 2007/0248468 A1 Oct. 25, 2007

(30) Foreign Application Priority Data

Apr. 20, 2006 (FI) ..... 06112815.3

(51) Int. Cl.
*F04B 49/06* (2006.01)

(52) U.S. Cl.
USPC ..... 417/44.2; 417/44.1; 417/44.11

(58) Field of Classification Search
USPC ..... 417/44.1, 44.2, 43, 45, 53
See application file for complete search history.

(56) References Cited

U.S. PATENT DOCUMENTS 4,629,116 A 12/1986 Laing et al.
5,160,244 A * 11/1992 Kuwabara et al. ..... 417/36
5,299,446 A * 4/1994 Pardinas et al. ..... 73/1.36
5,580,221 A * 12/1996 Triezenberg ..... 417/44.2
6,783,328 B2 * 8/2004 Lucke et al. ..... 417/44.2
2004/0047736 A1 3/2004 Nose et al.
2005/0123408 A1 * 6/2005 Koehl ..... 417/53
2005/0206360 A1 * 9/2005 Mehas et al. ..... 323/282
2008/0063535 A1 * 3/2008 Koehl ..... 417/18

FOREIGN PATENT DOCUMENTS

| | | |
|---|---|---|
| DE | 32 10641 | 10/1983 |
| DE | 4025 168 | 3/1991 |
| DE | 42 43 118 | 6/1994 |
| EP | 0 709 575 | 5/1996 |
| EP | 0 978 657 | 2/2000 |

* cited by examiner

*Primary Examiner* — Peter J Bertheaud
(74) *Attorney, Agent, or Firm* — Young & Thompson

(57) ABSTRACT

A method and arrangement for soft start up of a pump system, that includes a pump for generating a liquid flow, an electrical drive disposed to actuate the pump, and a pressure sensor disposed to measure a liquid pressure at a flow output of the pump. The rate of change of rotation speed of the pump during a start up phase is dependent on a rate of change of measured liquid pressure, wherein the rate of change of the rotation speed is a descending function of the rate of change of the measured liquid pressure.

6 Claims, 8 Drawing Sheets

METHOD AND ARRANGEMENT FOR SOFT START UP OF A PUMP SYSTEM

FIELD OF THE INVENTION

The invention relates to a method and arrangement for soft start up of a pump system. The invention is preferably, but not necessarily, applied to pump systems in which a pump is driven by an alternating-current motor, whose rotation speed is controlled by a control unit, such as e.g. a frequency converter.

BACKGROUND OF THE INVENTION

Pump systems are used in the industries and in public utility services, among other things. In industrial applications, pump systems are in most cases used in connection with production processes, while they relate to transfer of pure water, rain water and waste water in municipal engineering. In conjunction with starting up of a pump system, there can be a situation that pipes into which a pump is intended to feed liquid are not filled with liquid at the beginning of the starting phase. This kind of situation is repeatedly present e.g. with a movable irrigation pump system. When an irrigation pump system is moved from one place to a new place there is usually a situation that in the new place the pipes are empty or incompletely filled. Another application having frequent start ups with empty or incompletely filled pipes is a snow-machine in which there is a need to empty the pipes after use in order to avoid freezing in the pipes.

Pump systems used for liquid transfer usually consist of an electrically driven pump. The electric drive consists of a suitable power supply circuit, an electric motor and a control unit suitable for controlling and/or adjusting this. The pump operates as a mechanical load on the electric drive. A frequently used electric motor in pump systems is an alternating-current motor, especially an induction motor. The control unit used in an alternating current motor often consists of a frequency converter because of the benefits gained by this. Rotation speeds of the electric motor and the pump are adjusted by the frequency converter, which converts the frequency of the voltage supplied to the motor. The frequency converter, again, is adjusted by appropriate electric control signals.

Controlling the speed of a pump during a start up when pipes connected to a flow output of the pump are empty or incompletely filled is a challenging task from the viewpoint of avoiding pressure peaks in the pipes at the moment when the pipes get full of liquid. This is due to a fact that a counter-pressure versus flow rate characteristics that is prevailing at the flow output of the pump is rapidly changed when the pipes get full of liquid.

DESCRIPTION OF THE PRIOR ART

A prior art pump system is illustrated in FIG. 1. The pump 101 is actuated by an electric drive consisting of a power supply 102, a frequency converter 103 that comprises a control unit 105, and alternating-current motor 104 that in this case is a three-phase induction motor. The motor is usually connected to the pump with the rotation speed of the motor and the rotation speed of the pump being identical. The power supply comprises an alternating-current network, such as a three-phase network, or the like, for supplying electric power to the electric drive. Pressure of liquid at a flow output of the pump is measured in the system of FIG. 1 with a pressure sensor 106. Measured liquid pressure value 107 is coupled to the control unit of the frequency converter. The control unit forms a PI-controller (proportional and integrative) that is disposed to control an output frequency of the frequency converter according to a difference between the measured liquid pressure value 107 and a target value of pressure. Therefore, the rotation speed of the pump 101 is PI-controlled according to said difference. In FIG. 1 a pipe 108 represents a piping system connected to the flow output of the pump. A block 109 represents a system through which liquid flows out from the piping system, e.g. nozzles of an irrigation system.

When a pump system of FIG. 1 is started up in a situation in which the piping system 108 is empty or incompletely filled the difference between the measured and the target pressure is high and, therefore, the control unit makes the pump to run at substantially maximum speed. Therefore, at the moment when the piping system gets full of liquid there is a risk for pressure peaks in the piping system. The over pressure peaks stress the mechanical strength of the piping system and may cause leakages.

A solution according to prior art for avoiding the pressure peaks of the kind mentioned above is to limit a rate of change of the rotation speed of the pump below a predetermined maximum value. I.e. when there is a high difference between the measured and the target pressure the rotation speed is ramped up according to the predetermined maximum value. The maximum value is configured as a control parameter value. With this approach, however, one needs to perform experiments and/or to perform theoretical studies using a priori knowledge about the piping system in order to be able determine a suitable maximum value that does not lead to an unacceptably slow starting up process but, on the other hand, does not cause too strong pressure peaks. These kinds of experiments and/or theoretical studies make a commissioning of a pump system time consuming and costly. Furthermore, a maximum value that is suitable for a certain piping system can be far from being suitable for another piping system, i.e. the maximum value has to be searched individually for different piping systems.

BRIEF DESCRIPTION OF THE INVENTION

An object of the invention is to provide a new method and arrangement for controlling rotation speed of a pump during a start up phase so that the drawbacks associated with the prior art are eliminated or reduced. A further object of the invention is to provide a frequency converter that can be used in a pump system so that the drawbacks associated with the prior art are eliminated or reduced The objectives of the invention are achieved with a solution in which a rate of change of rotation speed of a pump during a start up phase is made to be dependent on a rate of change of measured liquid pressure in such a way that the rate of change of the rotation speed is a descending function of the rate of change of the measured liquid pressure.

In this document a characterization "descending" for a function F means that $F(x) \leq F(y)$ when $x > y$, where x and y are real numbers each of them can be used as an argument of the function F.

The rate of change of the rotation speed of a pump can be adjusted to a value determined by the rate of change of the measured liquid pressure e.g. by adjusting a rate of change of output frequency of a frequency converter that is feeding an alternating-current electrical motor that drives the pump. Increasing the output frequency of the frequency converter can be accomplished in a smooth or stepwise manner.

The invention yields appreciable benefits compared to prior art solutions:

the solution of the invention allows that same control parameter values that describe dependency between the rate of change of the measured liquid pressure and the rate of change of the rotation speed are suitable for mutually different piping systems, and the solution of the invention allows that amount of experiments and/or theoretical studies in conjunction with commissioning a pump system is reduced; thus saving commissioning costs.

A method according to the invention for starting up a pump system, in which a liquid flow is generated with a pump and a liquid pressure is measured at a flow output of the pump, is characterised in that the method comprises:

detecting a change in the liquid pressure, and adjusting a rate of change of rotation speed of the pump to be a descending function of a rate of change of the liquid pressure.

An arrangement according to the invention for starting up a pump system comprising a pump for generating a liquid flow, an electrical drive disposed to actuate the pump, and a pressure sensor disposed to measure liquid pressure at a flow output of the pump, is characterised in that the arrangement comprises:

a control unit disposed to detect change in the liquid pressure and to adjust a rate of change of rotation speed of the pump to be a descending function of a rate of change of the liquid pressure.

A frequency converter according to the invention comprising an inverter stage disposed to produce an output voltage of the frequency converter and a signal input interface disposed to receive a control signal, is characterised in that the frequency converter comprises:

a control unit disposed to detect a change in the control signal and to adjust a rate of change of frequency of the output voltage to be a descending function of a rate of change of the control signal.

A number of embodiments of the invention are described in the dependent claims.

Features of various advantageous embodiments of the invention are described below.

The exemplary embodiments of the invention presented in this document are not to be interpreted to pose limitations to the applicability of the appended claims. The verb "to comprise" is used in this document as an open limitation that does not exclude the existence of also unrecited features. The features recited in depending claims are mutually freely combinable unless otherwise explicitly stated.

BRIEF DESCRIPTION OF THE FIGURES

The invention and its other advantages are explained in greater detail below with reference to the preferred embodiments presented in the sense of examples and with reference to the accompanying drawings, in which.

DETAILED DESCRIPTION OF THE PREFERRED EMBODIMENTS OF THE INVENTION

Figure 1:
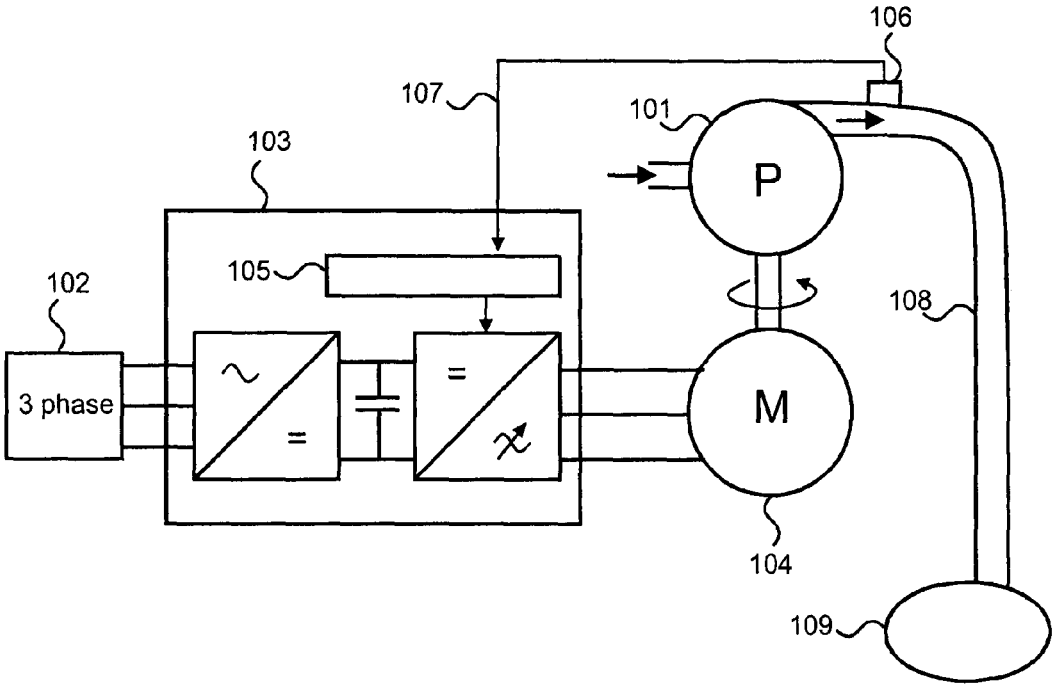
Figure 1 Prior art
FIG. 1 is a schematic view of the principle of a prior art pump system equipped with a frequency converter.

FIG. 1 has been explained above in the description of prior art.

Figure 2:
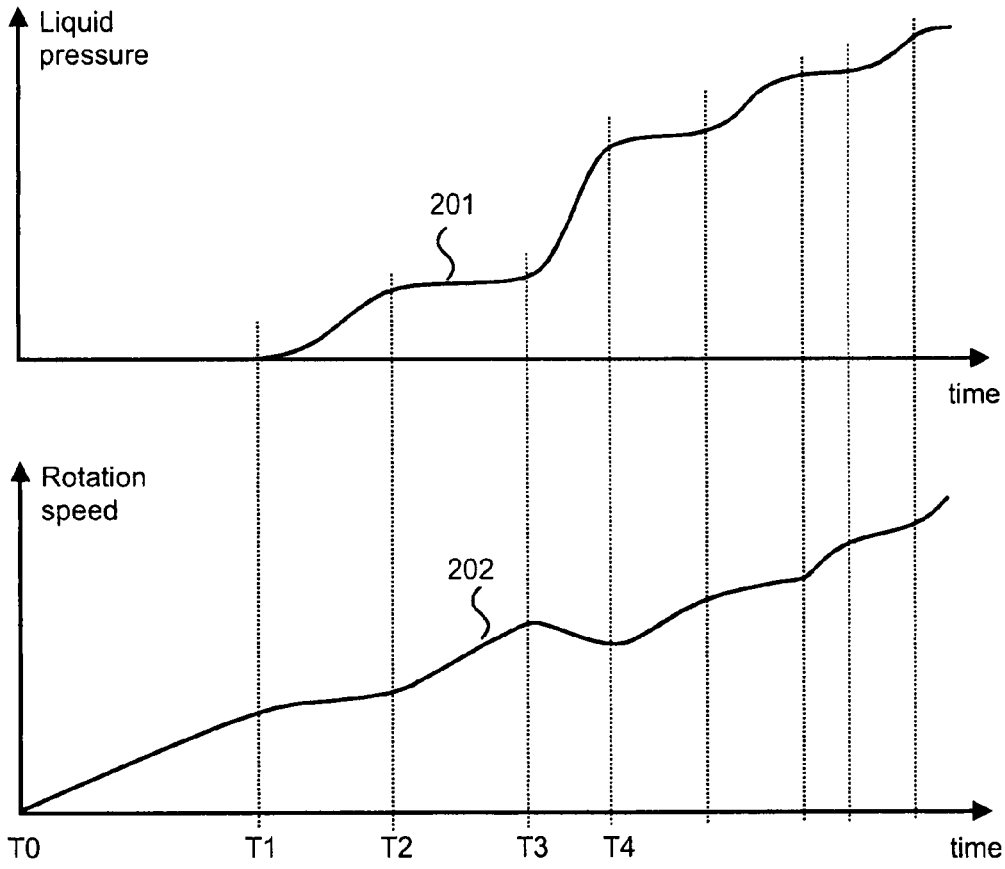
FIG. 2 illustrates measured liquid pressure and rotation speed of a pump as functions of time in an exemplary situation during a start up phase in a pump system according to an embodiment of the invention.

FIG. 2 illustrates measured liquid pressure and rotation speed of a pump as functions of time in an exemplary situation during a start up phase in a pump system according to an embodiment of the invention. A curve 201 illustrates the measured liquid pressure as a function of time and a curve 202 illustrates the rotation speed of the pump as a function of time. At the beginning of the start up phase during a time interval T0 . . . T1 the measured liquid pressure is zero. Therefore, also a rate of change of the measured liquid pressure is zero during the time interval T0 . . . T1. During the time interval T0 . . . T1 the rate of change of the rotation speed is adjusted to a value illustrated by a slope of the curve 202. During a time interval T1 . . . T2 the rate of change of the measured liquid pressure is positive, i.e. the measured liquid pressure is increasing. Therefore, on the time interval T1 . . . T2 the rate of change of the rotation speed is adjusted to a value that is smaller than that on the time interval T0 . . . T1. I.e. a bigger rate of change of the measured liquid pressure leads to a smaller rate of change of the rotation speed. During a time interval T2 . . . T3 the rate of change of the measured liquid pressure is again near zero and the rate of change of the rotation speed is made bigger. During a time interval T3 . . . T4 the measured liquid pressure increases so rapidly that the rate of change of the rotation speed is adjusted to a negative value, i.e. the rotation speed is decreasing. As can be seen from the above-analysed exemplary situation the rate of change of the rotation speed is a descending function of the rate of change of the measured liquid pressure.

In order to illustrate the basics of the invention let us consider an embodiment of the invention in which the descending function has the following form:

$$\frac{dr}{dt} = k_0 - k_1 \frac{dp}{dt}, \tag{1}$$

where dr/dt is the rate of change of the rotation speed [revolutions/second$^2$], dp/dt is the rate of change of the measured liquid pressure [Pascal/second], and $k_0$ and $k_1$ are a positive constants. The function shown in equation (1) is descending with respect to dp/dt since $k_1$ is positive. Principle of operation during a start up phase is illustrated clearly if both sides of equation (1) are integrated with respect to time. With the assumptions that the rotation speed and the pressure are zero at the beginning of the start up phase this yields:

$$r(t)=k_0t-k_1p(t), \tag{2}$$

where r(t) is the rotation speed as a function of time [revolutions/second], p(t) is the measured liquid pressure as a function of time [Pascal], and t is time.

As can been seen from equation (2) the rotation speed is ramped up with a ramp parameter $k_0$ so that the ramping up is softened according to the measured liquid pressure. This helps for avoiding harmful pressure peaks when a piping system gets full of liquid because the ramping up of the rotation speed ($k_0t$) is softened as the measured liquid pressure increases.

It should be noted that the descending function shown in equation (1) is only one example. The function shown in equation (1) was chosen as an example because it is easy to analyse. There are numerous different functions that can be used for the descending function, e.g.:

$$\frac{dr}{dt}=k_0-k_1\sqrt{\frac{dp}{dt}}. \tag{3}$$

The functions shown in equations (1) and (3) are time continuous functions. For example, the function shown in equation (1) can be realized with operational amplifiers, resistors, and capacitors. The descending function can also be realised in a time discrete way.

In an arrangement according to an embodiment of the invention for starting up a pump system a control unit of the pump system is disposed to control rotation speed of a pump on successive control intervals $T_{k-1}$ . . . $T_k$, where k is an integer (0, 1, 2, 3, . . . ) and $T_{k-1}$ and $T_k$ are start and end time instants of the control interval. A change in the measured liquid pressure is detected as a difference between values of the liquid pressure measured at different time instants. The rotation speed is controlled in the following way:

- if the change in measured liquid pressure detected during the control interval is below a first pre-determined threshold value, the rotation speed is increased with a first pre-determined change value (i.e. when the rate of change of the measured liquid pressure is below the first pre-determined threshold value/($T_k$–$T_{k-1}$) the rate of change of the rotation speed is adjusted to be the first pre-determined change value/($T_k$–$T_{k-1}$)),
- if the change in the measured liquid pressure is above or equal the first pre-determined threshold value and below a second pre-determined threshold value, the rotation speed is not changed, and
- if the change in the measured liquid pressure is above or equal the second pre-determined threshold value, the rotation speed is decreased with a second pre-determined change value.

The change in the measured liquid pressure can be also negative, e.g. in a case in which a valve in a piping system is suddenly opened during the start up phase of the pump system.

In an embodiment of the invention a length of the control interval is a changing quantity that is adjusted according to changes in the measured liquid pressure so that when the changes in the measured liquid pressure are big a shorter control interval is employed than when the changes are small. In an alternative embodiment of the invention the length of the control interval is constant.

Figure 3:
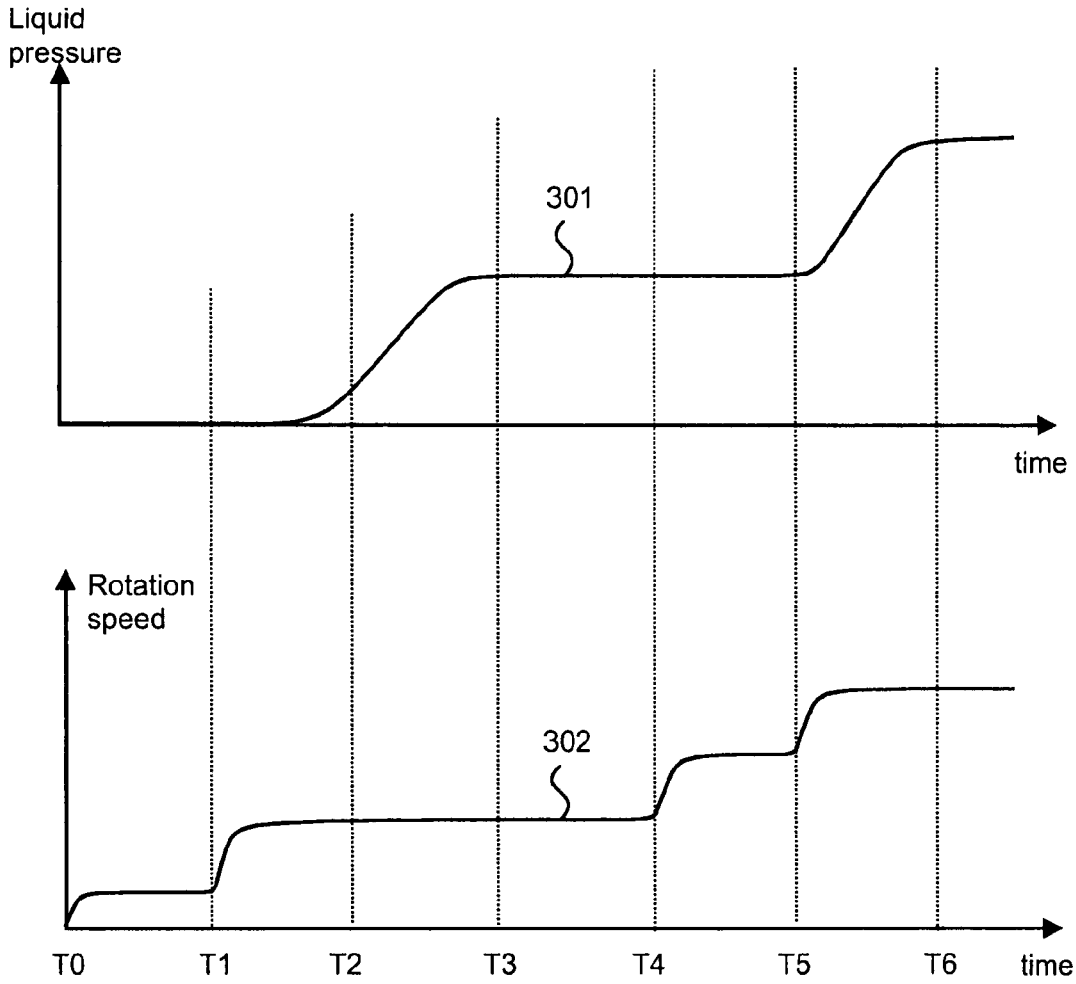
FIG. 3 illustrates measured liquid pressure and rotation speed of a pump as functions of time in an exemplary situation during a start up phase in a pump system according to an embodiment of the invention.

In an embodiment of the invention the first pre-determined threshold value is zero and the second pre-determined threshold value is not used. FIG. 3 illustrates measured liquid pressure and rotation speed of a pump as functions of time in an exemplary situation during a start up phase in a pump system according to this embodiment of the invention. A curve 301 illustrates the measured liquid pressure as a function of time and a curve 302 illustrates the rotation speed as a function of time. On a control interval T0 . . . T1 no change is detected in the liquid pressure. Therefore, at the end of the control interval T0 . . . T1 the rotation speed is decided to be increased. An increase in the rotation speed takes place at the beginning of the next control interval T1 . . . T2. An increase in the measured liquid pressure is detected on control intervals T1 . . . T2, T2 . . . T3, and T5 . . . T6. Therefore, at the ends of these control intervals (T2, T3, and T6) the rotation speed is decided to be unchanged.

Figure 4:
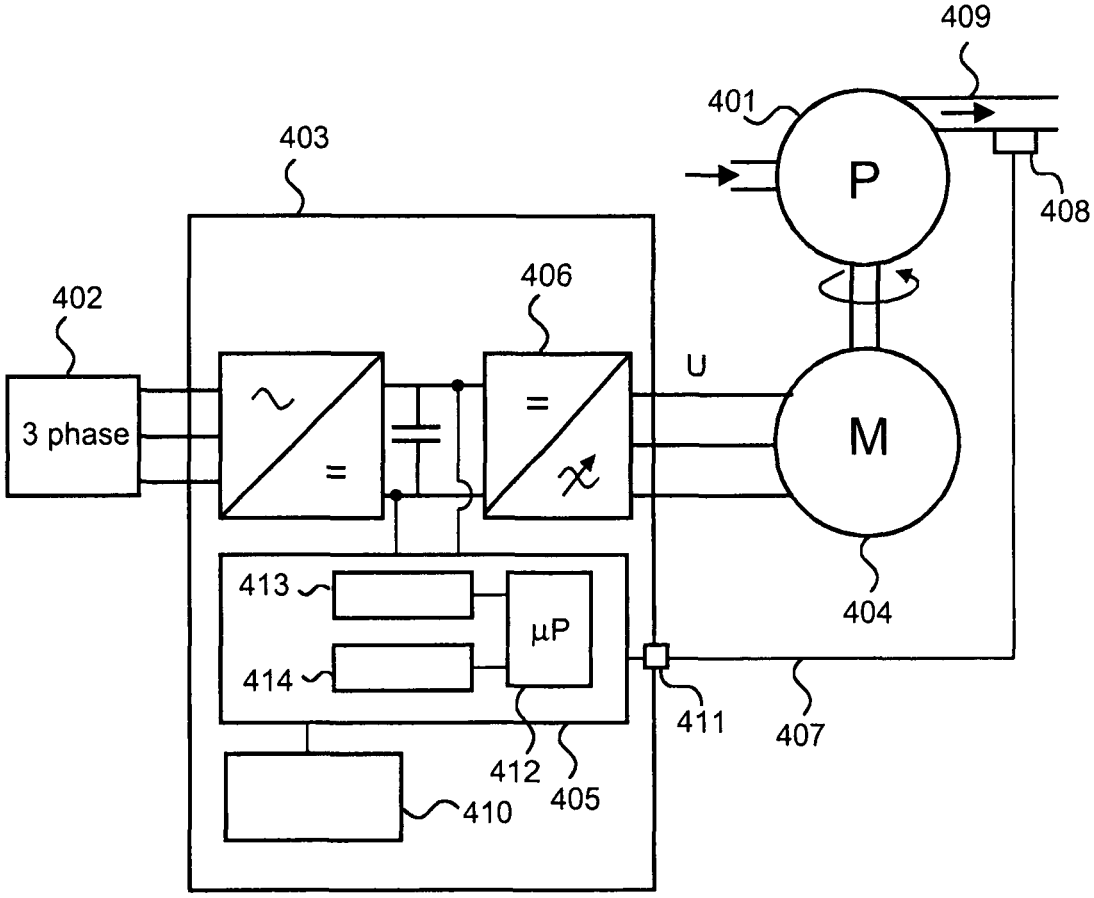
FIG. 4 shows a block diagram of a pump system comprising an arrangement according to an embodiment of the invention for controlling a start up phase of the pump system.

FIG. 4 shows a block diagram of a pump system comprising an arrangement according to an embodiment of the invention for controlling a start up phase of the pump system. The pump system comprises an electric drive for actuating the pump 401, the electrical drive consisting of an electric supply 402, a frequency converter 403 and an alternating-current electrical motor 404. The frequency converter 403 comprises a control unit 405 for controlling the operation of switches of an inverter stage 406 of the frequency converter. The control unit controls frequency and level of supply voltage U produced by the inverter stage 406. The supply voltage U is connected to input terminals of the electrical motor 404. The control unit also performs calculation of changes in measured liquid pressure and adjusts the frequency of the supply voltage U in accordance with the present invention. The control unit receives a control signal 407 via a signal input interface 411 from a pressure sensor 408 connected to a flow output 409 of the pump. The control signal 407 represents the measured liquid pressure. The frequency of the supply voltage U substantially determines rotation speed of the motor and, therefore, rotation speed of the pump too. The measured liquid pressure is shown on a display 410 connected to the control unit. The control unit may also have an interface for transferring data to another device or to a data transmission channel.

The control unit is disposed to detect changes in the measures liquid pressure and to adjust a rate of change of the rotation speed of the pump 401 to be a descending function of a rate of change of the measured liquid pressure. The control unit preferably comprises a processor 412 that is disposed to perform calculations connected with detecting changes in the measured liquid pressure and determining frequency of the supply voltage. The control unit also comprises a memory unit 413, in which parameters needed in the above-mentioned calculations and software controlling the processor are stored. The control unit may also comprise a measurement unit 414, which receives and processes signals obtained from the pressure sensor 408 and/or motor control.

In an arrangement according to an embodiment of the invention the control unit 405 is disposed to control the frequency of the supply voltage U on successive control intervals $T_{k-1}$ . . . $T_k$, where k is an integer (0, 1, 2, 3, . . . ) and $T_{k-1}$ and $T_k$ are start and end time instants of the control interval. The control unit 405 is disposed to detect a change ΔP in the measured liquid pressure according to a difference between values of the control signal 407 measured at different time instants and to control the frequency in the following way:

if the change ΔP in the measured liquid pressure detected during the control interval is below a first pre-determined threshold value TH1, the frequency is increased with a first pre-determined change value FC1 (i.e. when the rate of change of the measured liquid pressure is below TH1/($T_k$−$T_{k-1}$) the rate of change of the rotation speed is adjusted to be FC1/($T_k$−$T_{k-1}$)/number of pole pairs of the electrical motor), if the change ΔP in the measured liquid pressure is above or equal the first pre-determined threshold value TH1 and below a second pre-determined threshold value TH2, the frequency is not changed (i.e. when the rate of change of the measured liquid pressure is above or equal TH1/($T_k$−$T_{k-1}$) but below TH2/($T_k$−$T_{k-1}$) the rate of change of the rotation speed is set to zero), and if the change ΔP in the measured liquid pressure is above or equal the second pre-determined threshold value TH2, the frequency is decreased with a second pre-determined change value FC2 (i.e. when the rate of change of the measured liquid pressure is above or equal TH2/($T_k$−$T_{k-1}$) the rate of change of the rotation speed is adjusted to be −FC2/($T_k$−$T_{k-1}$)/number of pole pairs of the electrical motor).

Figure 5:
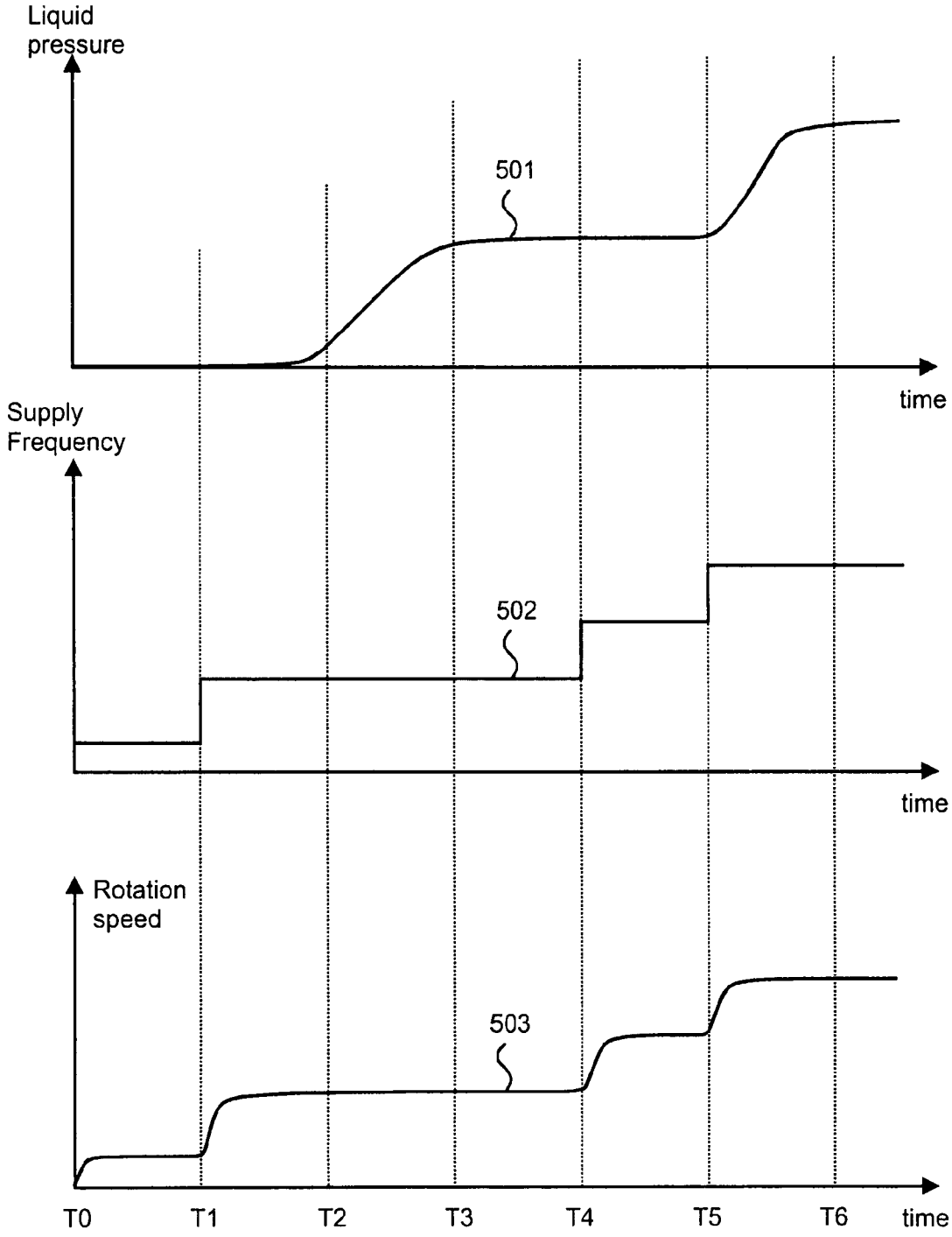
FIG. 5 illustrates measured liquid pressure, supply frequency of an electrical motor, and rotation speed of a pump as functions of time in an exemplary situation during a start up phase in a pump system according to an embodiment of the invention.

FIG. 5 illustrates the measured liquid pressure, the frequency of the supply voltage, and the rotation speed of a pump as functions of time in an exemplary situation in which the first pre-determined threshold value of the change in the measured liquid pressure is zero and the second pre-determined threshold value is not used. A curve 501 illustrates the measured liquid pressure as a function of time, a curve 502 illustrates the frequency of the supply voltage as a function of time, and a curve 503 illustrates the rotation speed as a function of time. On a control interval T0 . . . T1 no change is detected in the liquid pressure. Therefore, at the end of the control interval T0 . . . T1 the frequency is decided to be increased. An increase in the rotation speed takes place at the beginning of the next control interval T1 . . . T2. An increase in the measured liquid pressure is detected on control intervals T1 . . . T2, T2 . . . T3, and T5 . . . T6. Therefore, at the ends of these control intervals (T2, T3, and T6) the frequency is decided to be unchanged.

A length of the control interval can be a changing quantity that is adjusted with the control unit 405 according to changes in the measured liquid pressure so that when the changes in the measured liquid pressure are big a shorter control interval is employed than when the changes are small. Alternatively the length of the control interval can be constant.

In an arrangement according to an embodiment of the invention the control unit 405 is disposed to switch the pump system to a PID-controlled state when the measured liquid pressure reaches a pre-determined limit value. In the PID-controlled state the rotation speed is controlled with a PID-controller according to a difference between the measured liquid pressure and a reference value of the liquid pressure. The PID-controller is a proportional, integrative, and derivative controller according to prior art. In this document a P- and a PI-controller are seen to be sub-types of a PID-controller. The PID- (PI-, or P-) controller can be realised with the control unit 405.

In an arrangement according to an alternative embodiment of the invention the control unit 405 is disposed to switch the pump system to the PID-controlled state when the rotation speed reaches a pre-determined limit value.

Figure 6:
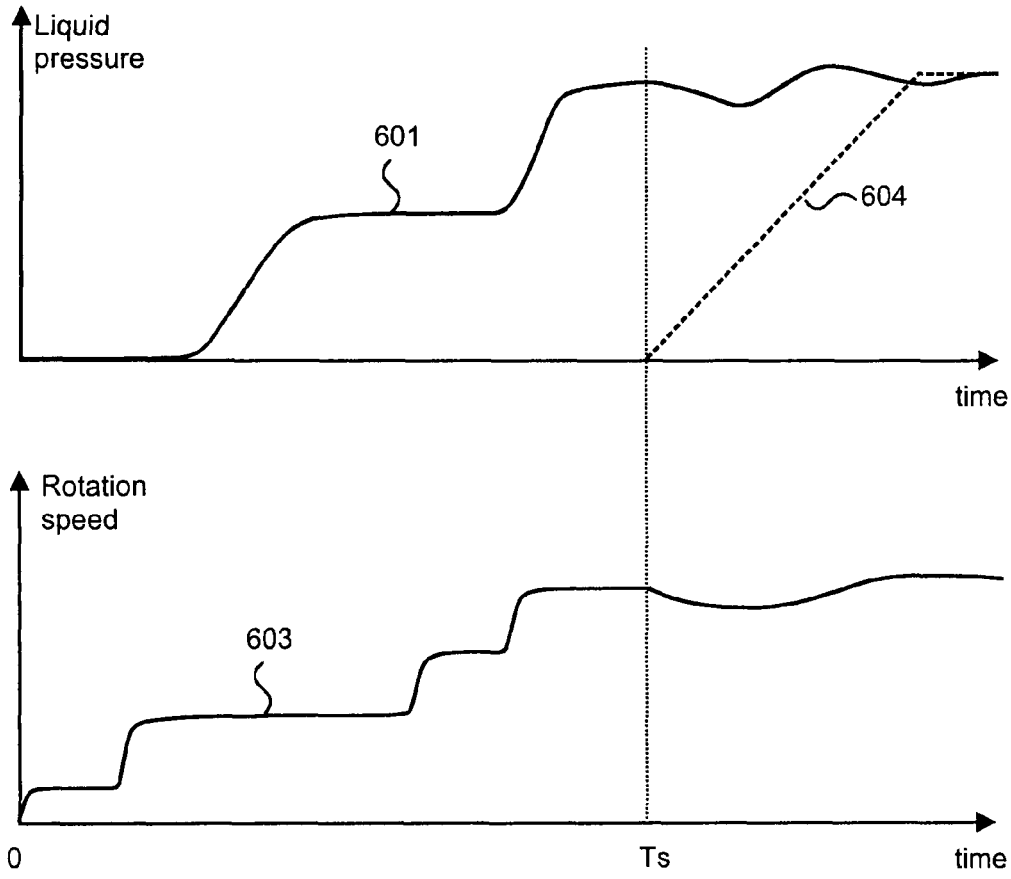
FIG. 6 illustrates measured liquid pressure, rotation speed of a pump, and a reference value of a PID-controller as functions of time in an exemplary situation during a start up phase in a pump system according to an embodiment of the invention.

In an arrangement according to an embodiment of the invention the control unit 405 is disposed to ramp up the reference value of the liquid pressure from its initial value to its final value within a predetermined time at the beginning of the use of the PID-controller. This is illustrated in FIG. 6 where a curve 601 represents the measured liquid pressure, a dashed line 604 represents the reference value for the PID-controller, and a curve 603 represents the rotation speed of the pump. The ramping up of the reference value 604 can be performed in a smooth manner as in FIG. 6 or in a stepwise manner. In the exemplary situation shown in FIG. 6 the PID-controller is taken into use at a time instant Ts.

An arrangement according to an embodiment of the invention can be used for starting up a pump of a booster pump station. An arrangement according to an embodiment of the invention can be used for starting up a pump of an irrigation pump station. An arrangement according to an embodiment of the invention can be used for stating up a pump of a snow-machine.

Frequency converters according to certain embodiments of the invention are described below with the aid of FIG. 4. A frequency converter 403 according to an embodiment of the invention comprises an inverter stage 406 disposed to produce an output voltage of the frequency converter, a signal input interface 411 disposed to receive a control signal 407, and a control unit 405 disposed to detect a change in the control signal and to adjust a rate of change of frequency of the output voltage to be a descending function of a rate of change of the control signal.

In a frequency converter according to an embodiment of the invention the control unit 405 is disposed to increase the output frequency with a first pre-determined change value as a response to the change in the control signal 407 being below a first pre-determined threshold value.

In a frequency converter according to an embodiment of the invention the control unit 405 is disposed to decrease the output frequency with a second pre-determined change value as a response to the change in the control signal being above a second pre-determined threshold value, where the second pre-determined threshold value is greater than the first pre-determined threshold value.

In a frequency converter according to an embodiment of the invention the control unit 405 is disposed to switch to a PID-controlled state as a response to an event in which the control signal reaches a pre-determined limit value. In the PID-controlled state the output frequency is controlled with a PID-controller according to a difference between the control signal 407 and a reference value of the control signal. The PID- (PI-, or P-) controller is realised with the control unit 405.

In a frequency converter according to an embodiment of the invention the control unit 405 is disposed to switch to the PID-controlled state as a response to an event in which the output frequency reaches a pre-determined limit value.

In a frequency converter according to an embodiment of the invention the control unit 405 is disposed to ramp up the reference value of the control signal from its initial value to its final value within a pre-determined time as a response to switching to the PID-controlled state.

Figure 7:
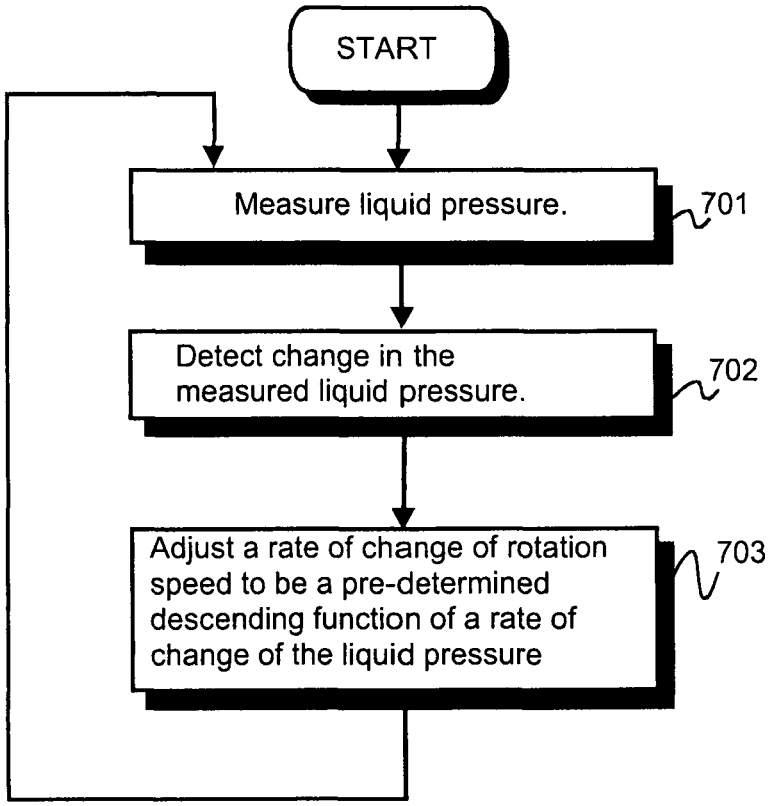
FIG. 7 shows a flow chart illustrating a method according to an embodiment of the invention for starting up a pump system.

FIG. 7 shows a flow chart illustrating a method according to an embodiment of the invention for starting up a pump system. In phase 701 a liquid pressure is measured at flow output of a pump. In phase 702 temporal changes in the measured liquid pressure are detected. In phase 703 a rate of change of rotation speed of the pump is adjusted to be a descending function of a rate of change of the liquid pressure.

Figure 8:
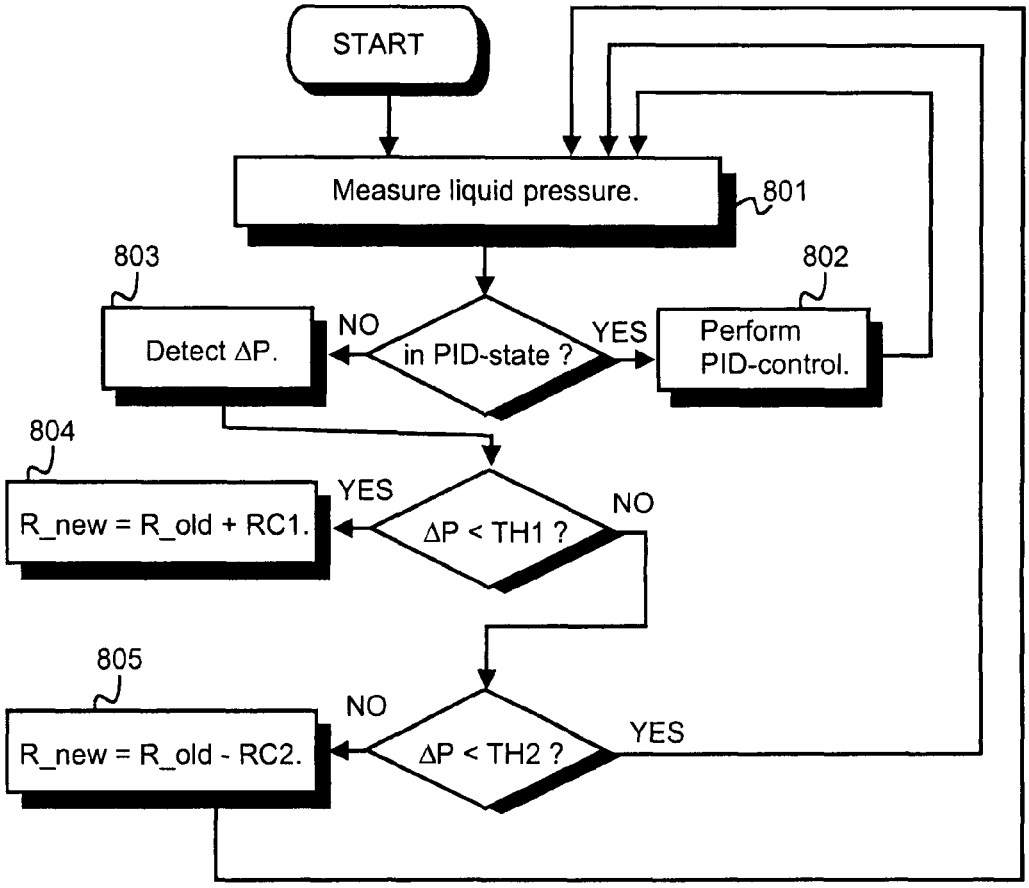
FIG. 8 shows a flow chart illustrating a method according to an embodiment of the invention for starting up a pump system.

FIG. 8 shows a flow chart illustrating a method according to an embodiment of the invention for starting up a pump system. The liquid pressure is measured in phase 801. When the pump system is in a PID-controlled state rotation speed of a pump is controlled with a PID-controller according to a difference between measured liquid pressure and a reference liquid pressure, phase 802. When the system is not in the PID-controlled state the rotation speed is controlled on successive control intervals $T_{k-1} \ldots T_k$, where k is an integer (0, 1, 2, 3, . . . ) and $T_{k-1}$ and $T_k$ are start and end time instants of the control interval. In phase 803 a change ΔP in the measured liquid pressure is detected as a difference between values of the liquid pressure measured at different time instants. The rotation speed is controlled on a control interval $T_{k-1} \ldots T_k$ in the following way:

if the change ΔP in the measured liquid pressure is below a first pre-determined threshold value TH1, the rotation speed R is increased in phase 804 with a first pre-determined change value RC1 (i.e. when the rate of change of the measured liquid pressure is below $TH1/(T_k-T_{k-1})$ the rate of change of the rotation speed is adjusted to be $RC1/(T_k-T_{k-1})$), if the change ΔP in the measured liquid pressure is above or equal the first pre-determined threshold value TH1 and below a second pre-determined threshold value TH2, the rotation speed R is not changed (i.e. when the rate of change of the measured liquid pressure is above or equal $TH1/(T_k-T_{k-1})$ but below $TH2/(T_k-T_{k-1})$ the rate of change of the rotation speed is set to zero), and if the change ΔP in the measured liquid pressure is above or equal the second pre-determined threshold value TH2, the rotation speed R is decreased in a phase 805 with a second pre-determined change value RC2 (i.e. when the rate of change of the measured liquid pressure is above or equal $TH2/(T_k-T_{k-1})$ the rate of change of the rotation speed is adjusted to be $-RC2/(T_k-T_{k-1})$)

At the beginning of the next control interval $T_k \ldots T_{k+1}$ the operation returns to the phase 801.

Figure 9:
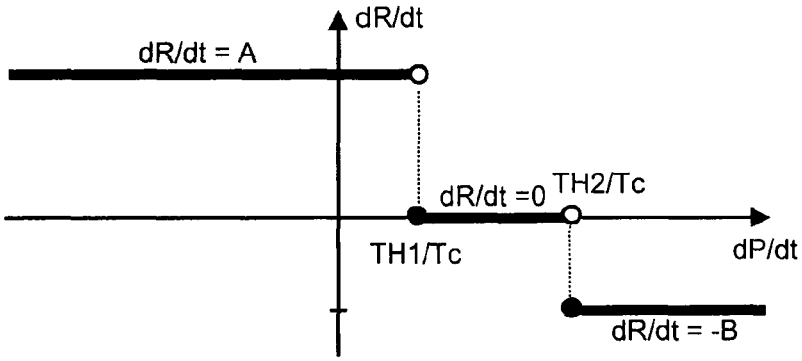
FIG. 9 is a graphical presentation of a rate of change of rotation speed as a descending function of a rate of change of measured liquid pressure.

FIG. 9 is a graphical presentation of the rate of change of the rotation speed dR/dt as a descending function of the rate of change of the measured liquid pressure dP/dt. Values A, B and Tc in FIG. 9 are $RC1/(T_k-T_{k-1})$, $-RC2/(T_k-T_{k-1})$, and $T_k-T_{k-1}$, respectively.

In a method according to an embodiment of the invention the pump system is switched to the PID-controlled state when the measured liquid pressure reaches a pre-determined limit value.

In a method according to an alternative embodiment of the invention the pump system is switched to the PID-controlled state when the rotation speed reaches a pre-determined limit value.

In a method according to an embodiment of the invention a reference value of the liquid pressure is ramped up from its initial value to its final value within a predetermined time as a response to an event in which the pump system is changed to the PID-controlled state.

In a method according to an embodiment of the invention the rate of change of the rotation speed is adjusted by adjusting an output frequency of a frequency converter that is supplying an alternating current electrical motor that actuates the pump in such a way that a rate of change of the output frequency is a descending function of the rate of change of the liquid pressure.

The invention has been explained above mainly by means of an electrical drive comprising a frequency converter as the control unit and an alternating-current electrical motor. However, a person skilled in the art evidently applies the invention to other types of electrical drives as well, e.g. an electrical drive comprising a commutator direct-current electrical motor and an adjustable direct current source like a thyristor bridge. A control unit of the adjustable direct current source can be used as a control unit needed in an embodiment of the invention in a same way as the control unit of the frequency converter. It is also possible to use a separate control unit for operations associated with the invention.

Exemplifying methods according to some embodiments of the invention are defined below with the aid of the following numbered clauses 1-7:

Clause 1. A method for starting up a pump system in which a liquid flow is generated with a pump and liquid pressure is measured at a flow output of the pump, the method comprising:

detecting a change in the liquid pressure, and adjusting a rate of change of rotation speed of the pump to be a descending function of a rate of change of the liquid pressure.

Clause 2. A method according to Clause 1, wherein the rotation speed is increased with a first pre-determined change value if the change in the liquid pressure is below a first pre-determined threshold value.

Clause 3. A method according to Clause 2, wherein the rotation speed is decreased with a second pre-determined change value if the change in the liquid pressure is above a second pre-determined threshold value, the second pre-determined threshold value being greater than the first predetermined threshold value.

Clause 4. A method according to Clause 1, wherein the pump system is switched to a PID-controlled (proportional, integrative, and derivative) state as a response to an event in which a measured value of the liquid pressure reaches a pre-determined limit value, in the PID-controlled state the rotation speed being controlled with a PID-controller according to a difference between the liquid pressure and a reference value of the liquid pressure.

Clause 5. A method according to Clause 1, wherein the pump system is switched to a PID-controlled state as a response to an event in which the rotation speed reaches a pre-determined limit value, in the PID-controlled state the rotation speed being controlled with a PID-controller according to a difference between the liquid pressure and a reference value of the liquid pressure.

Clause 6. A method according to Clause 4 or 5, wherein the reference value of the liquid pressure is ramped up from its initial value to its final value within a pre-determined time as a response to switching the pump system to the PID-controlled state.

Clause 7. A method according to Clause 1, wherein the rate of change of the rotation speed is adjusted by adjusting an output frequency of a frequency converter that is supplying an alternating current electrical motor that actuates the pump in such a way that a rate of change of the output frequency is a descending function of the rate of change of the liquid pressure.

Exemplifying arrangements according to some embodiments of the invention are defined below with the aid of the following numbered clauses 8-14:

Clause 8. An arrangement for starting up a pump system, the pump system comprising a pump for generating a liquid flow, an electrical drive disposed to actuate the pump, and a pressure sensor disposed to measure liquid pressure at a flow output of the pump, the arrangement comprising a control unit disposed to detect a change in the liquid pressure and to adjust a rate of change of rotation speed of the pump to be a descending function of a rate of change of the liquid pressure.

Clause 9. An arrangement according to Clause 8, wherein the control unit is disposed to increase the rotation speed with a first pre-determined change value as a response to the change in the liquid pressure being below a first pre-determined threshold value.

Clause 10. An arrangement according to Clause 9, wherein the control unit is disposed to decrease the rotation speed with a second pre-determined change value as a response to the change in the liquid pressure being above a second pre-determined threshold value, the second pre-determined threshold value being greater than the first predetermined threshold value.

Clause 11. An arrangement according to Clause 8, wherein the control unit is disposed to switch the pump system to a PID-controlled (proportional, integrative, and derivative) state as a response to an event in which a measured value of the liquid pressure reaches a pre-determined limit value, in the PID-controlled state the rotation speed being controlled with a PID-controller according to a difference between the liquid pressure and a reference value of the liquid pressure.

Clause 12. An arrangement according to Clause 8, wherein the control unit is disposed to switch the pump system to a PID-controlled state as a response to an event in which the rotation speed reaches a pre-determined limit value, in the PID-controlled state the rotation speed being controlled with a PID-controller according to a difference between the liquid pressure and a reference value of the liquid pressure.

Clause 13. An arrangement according to Clause 11 or 12, wherein the control unit is disposed to ramp up the reference value of the liquid pressure from its initial value to its final value within a pre-determined time as a response to switching the pump system to the PID-controlled state.

Clause 14. An arrangement according to Clause 8, wherein the electrical drive comprises a frequency converter and an alternating current electrical motor, the electrical drive being disposed to adjust the rate of change of the rotation speed by adjusting a rate of change of output frequency of the frequency converter.

Exemplifying frequency converters according to some embodiments of the invention are defined below with the aid of the following numbered clauses 15-20:

Clause 15. A frequency converter, comprising:

an inverter stage disposed to produce an output voltage of the frequency converter, a signal input interface disposed to receive a control signal, and a control unit disposed to detect a change in the control signal and to adjust a rate of change of frequency of the output voltage to be a descending function of a rate of change of the control signal.

Clause 16. A frequency converter according to Clause 15, wherein the control unit is disposed to increase the output frequency with a first pre-determined change value as a response to the change in the control signal being below a first pre-determined threshold value.

Clause 17. A frequency converter according to Clause 16, wherein the control unit is disposed to decrease the output frequency with a second pre-determined change value as a response to the change in the control signal being above a second pre-determined threshold value, the second pre-determined threshold value being greater than the first predetermined threshold value.

Clause 18. A frequency converter according to Clause 15, wherein the control unit is disposed to switch to a PID-controlled (proportional, integrative, and derivative) state as a response to an event in which the control signal reaches a pre-determined limit value, in the PID-controlled state the output frequency being controlled with a PID-controller according to a difference between the control signal and a reference value of the control signal.

Clause 19. A frequency converter according to Clause 15, wherein the control unit is disposed to switch to a PID-controlled state as a response to an event in which the output frequency reaches a pre-determined limit value, in the PID-controlled state the output frequency being controlled with a PID-controller according to a difference between the control signal and a reference value of the control signal.

Clause 20. A frequency converter according to Clause 18 or 19, wherein the control unit is disposed to ramp up the reference value of the control signal from its initial value to its final value within a pre-determined time as a response to switching to the PID-controlled state.

The invention is not limited merely to the embodiments described above, many variants being possible without departing from the scope of the inventive idea defined in the independent claims.

What is claimed is:

1. An arrangement for starting up a pump system, the pump system comprising a pump for generating a liquid flow, an electrical drive disposed to actuate the pump, and a pressure sensor disposed to measure liquid pressure at a flow output of the pump, the arrangement comprising a control unit arranged to detect, during a first one of successive temporal control intervals while the pump is starting, whether there is an increase in the liquid pressure, wherein the control unit is further arranged to detect, during each of the successive temporal control intervals after the first one of the successive temporal control intervals and in response to a situation in which no increase in the liquid pressure was detected during the preceding one of the successive temporal control intervals, whether the liquid pressure has increased, the control unit is further arranged to detect, during each of the successive temporal control intervals after the first one of the successive temporal control intervals and in response to a situation in which an increase in the liquid pressure was detected during the preceding one of the successive temporal control intervals, whether the liquid pressure has increased, the control unit is further arranged to respond to detection of no increase in the liquid pressure in one of the successive temporal control intervals, after the first one of the successive temporal control intervals, by increasing a rotation speed of the pump during an immediately following one of the successive temporal control intervals, the control unit is further arranged to respond to detection of an increase in the liquid pressure in one of the successive temporal control intervals, after the first one of the successive temporal control intervals, by keeping unchanged the rotation speed of the pump during an immediately following one of the successive temporal control intervals, and the rotation speed of the pump at the beginning of each of the successive temporal control intervals after the first one of the successive temporal control intervals is at least partly determined by the rotation speed of the pump at the end of the previous one of the successive temporal control intervals.

2. An arrangement according to claim 1, wherein the control unit is disposed to switch the pump system to a PID-controlled state as a response to an event in which a measured value of the liquid pressure reaches a pre-determined limit value, in the PID-controlled state the rotation speed being controlled with a PID-controller according to a difference between the liquid pressure and a reference value of the liquid pressure.

3. An arrangement according to claim 2, wherein the control unit is disposed to ramp up the reference value of the liquid pressure from an initial value to a final value within a pre-determined time as a response to switching the pump system to the PID-controlled state.

4. A frequency converter, comprising:

an inverter stage disposed to produce an output voltage of the frequency converter, a signal input interface disposed to receive a control signal, and a control unit arranged to detect, during a first one of successive temporal control intervals, whether the control signal has increased, wherein the control unit is further arranged to detect, during each of the successive temporal control intervals after the first one of the successive temporal control intervals and in response to a situation in which no increase in the control signal was detected during the preceding one of the successive temporal control intervals, whether the control signal has increased, the control unit is further arranged to detect, during each of the successive temporal control intervals after the first one of the successive temporal control intervals and in response to a situation in which an increase in the control signal was detected during the preceding one of the successive temporal control intervals, whether the control signal has increased, the control unit is further arranged to respond to detection of no increase in the control signal in one of the successive temporal control intervals, after the first one of the successive temporal control intervals, by increasing a frequency of the output voltage during an immediately following one of the successive temporal control intervals, the control unit is further arranged to respond to detection of an increase in the control signal in one of the successive temporal control intervals, after the first one of the successive temporal control intervals, by keeping unchanged the frequency of the output voltage during an immediately following one of the successive temporal control intervals, and the frequency of the output voltage at the beginning of each of the successive temporal control intervals after the first one of the successive temporal control intervals is at least partly determined by the frequency of the output voltage at the end of the previous one of the successive temporal control intervals.

5. The frequency converter according to claim 4, wherein the control unit is disposed to switch to a PID-controlled state as a response to an event in which the control signal reaches a predetermined limit value, in the PID-controlled state the output frequency being controlled with a PID-controller according to a difference between the control signal and a reference value of the control signal.

6. The frequency converter according to claim 5, wherein the control unit is disposed to ramp up the reference value of the control signal from an initial value to a final value within a pre-determined time as a response to switching to the PID-controlled state.

* * * * *